US010548346B2

(12) United States Patent
Wrobel

(10) Patent No.: US 10,548,346 B2
(45) Date of Patent: Feb. 4, 2020

(54) SMOKING PEN

(71) Applicant: Clear Creek Cannons LLC, Idaho Springs, CO (US)

(72) Inventor: Michael Jason Wrobel, Golden, CO (US)

(73) Assignee: Clear Creek Cannons LLC, Idaho Springs, CO (US)

( * ) Notice: Subject to any disclaimer, the term of this patent is extended or adjusted under 35 U.S.C. 154(b) by 0 days.

(21) Appl. No.: 15/634,585

(22) Filed: Jun. 27, 2017

(65) Prior Publication Data

US 2017/0367401 A1 Dec. 28, 2017

Related U.S. Application Data

(60) Provisional application No. 62/355,564, filed on Jun. 28, 2016.

(51) Int. Cl.

| | |
|---|---|
| ***A24F 1/28*** | (2006.01) |
| ***A24F 1/14*** | (2006.01) |
| ***F23Q 7/02*** | (2006.01) |

(52) U.S. Cl.

CPC ..... *A24F 1/28* (2013.01); *A24F 1/14* (2013.01); *F23Q 7/02* (2013.01)

(58) Field of Classification Search

CPC ..... A24F 1/28

See application file for complete search history.

(56) References Cited

U.S. PATENT DOCUMENTS

| | | | | |
|---|---|---|---|---|
| 1,463,398 | A * | 7/1923 | Longacre | A24F 1/28 131/191 |
| 2,065,223 | A * | 12/1936 | Hirsch | A24F 7/00 131/228 |
| 2,173,211 | A * | 9/1939 | Lykos | A24F 13/14 131/175 |
| 2,815,030 | A * | 12/1957 | Wenger | A24F 1/30 131/173 |
| 3,709,233 | A * | 1/1973 | Stelitano | A24F 1/28 131/176 |
| 4,774,970 | A * | 10/1988 | Bell | A24F 1/02 131/175 |
| 7,293,565 | B2 | 11/2007 | Griffin et al. | |
| 8,550,091 | B2 | 10/2013 | Yomtov et al. | |
| 2009/0288668 | A1 | 11/2009 | Inagaki | |
| 2009/0288670 | A1 * | 11/2009 | Lee | A23G 3/56 131/330 |
| 2009/0293888 | A1 | 12/2009 | Williams et al. | |

(Continued)

*Primary Examiner* — Eric Yaary

(74) *Attorney, Agent, or Firm* — Trenner Law Firm, LLC; Mark D. Trenner

(57) ABSTRACT

A smoking pen device is disclosed. An example smoking pen device includes a stem having an inlet end and an outlet end. The example smoking pen device also includes a first end piece connecting to the inlet end of the stem, the first end piece configured to receive a coil heated by electric current to combust a smoking product in the first end piece. The example smoking pen device also includes a second end piece on the outlet end of the stem. A gas or vapor from combustion of the smoking product flows from the first end piece through the stem and out of the second end piece. In an example, the second end piece is a mouth piece. In another example, the second end piece is configured to fit into an inlet port on a water pipe.

13 Claims, 8 Drawing Sheets

(56) References Cited

U.S. PATENT DOCUMENTS

| | | | | |
|---|---|---|---|---|
| 2009/0293892 | A1 | 12/2009 | Williams et al. | |
| 2010/0319716 | A1* | 12/2010 | Tao | A24F 1/30 131/173 |
| 2012/0186592 | A1* | 7/2012 | Schleider | A24F 1/28 131/191 |
| 2013/0025608 | A1* | 1/2013 | Fakhouri | A24F 9/00 131/311 |
| 2014/0217085 | A1 | 8/2014 | Alima | |

* cited by examiner

SMOKING PEN

PRIORITY CLAIM

This application claims the priority benefit of U.S. Provisional Patent Application No. 62/355,564 filed Jun. 28, 2016 titled "Smoking Pen" of Michael Jason Wrobel, hereby incorporated by reference as though fully set forth herein.

BACKGROUND

The so-called "vapor pen" is increasingly common given the restrictions on traditional cigarettes. However, these vapor pens often operate by battery power, which can take up to an hour to fully charge. These vapor pens may clog. Other smoking devices require a gas-powered torch to prepare the device prior to use. However, these provide poor combustion of the smoking product.

DETAILED DESCRIPTION

A smoking pen device is disclosed. An example smoking pen device includes a stem having an inlet end and an outlet end. The example smoking pen device also includes a first end piece connecting to the inlet end of the stem, the first end piece configured to receive a coil heated by electric current to combust a smoking product in the first end piece. The example smoking pen device also includes a second end piece on the outlet end of the stem. A gas or vapor from combustion of the smoking product flows from the first end piece through the stem and out of the second end piece. In an example, the second end piece is a mouth piece. In another example, the second end piece is configured to fit into an inlet port on a water pipe.

In an example, the smoking pen device may be used with any plant product or artificial oil (e.g., that can be "smoked" and/or "vaped"). The smoking pen device does not need to be prepared with a gas-powered torch, and there is no battery to charge. The smoking pen device provides instant results, and does not clog or improperly combust the product.

Before continuing, it is noted that as used herein, the terms "includes" and "including" mean, but is not limited to, "includes" or "including" and "includes at least" or "including at least." The term "based on" means "based on" and "based at least in part on."

Figure 1:
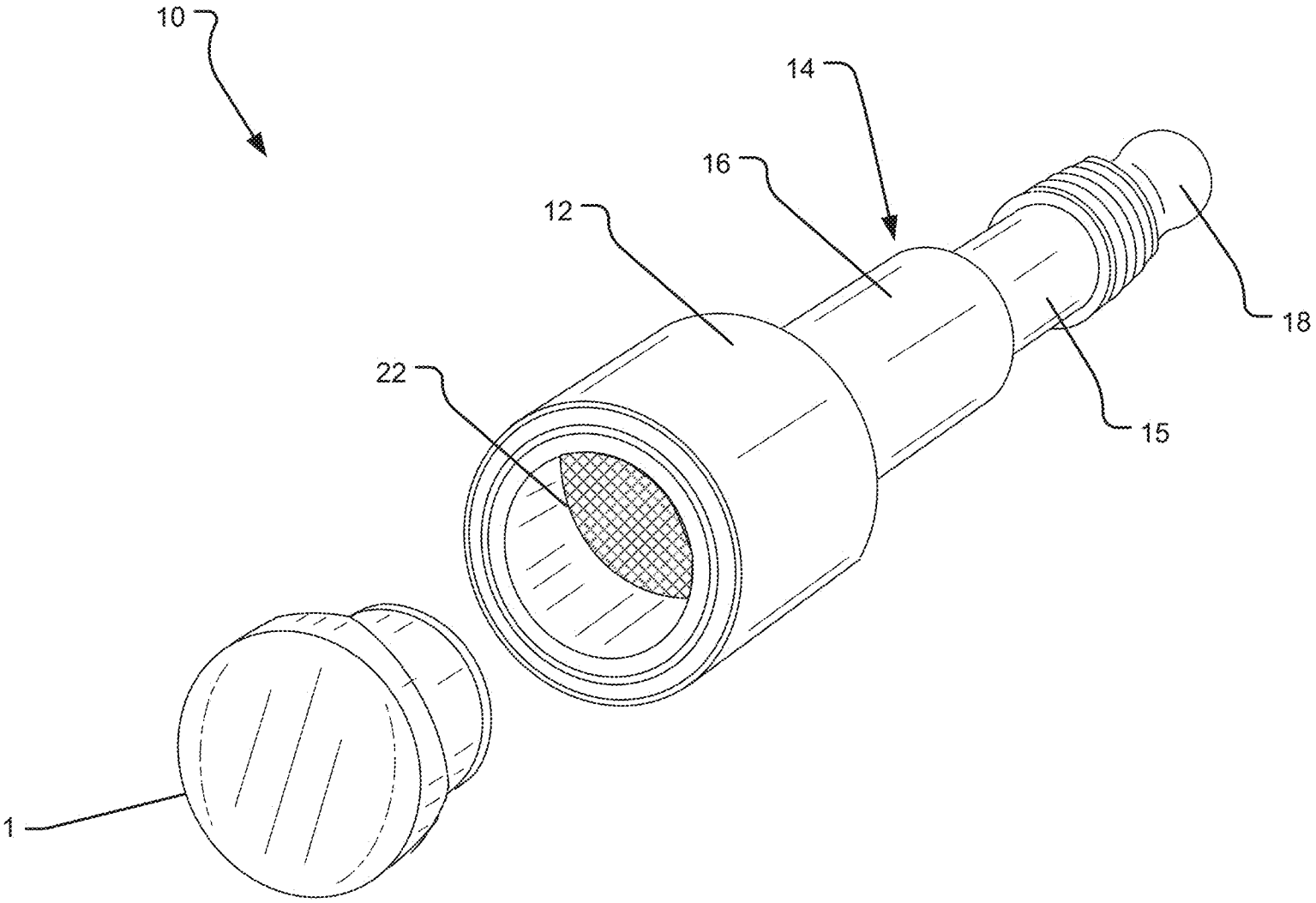
FIGS. 1 and 2 are perspective illustrations of an example smoking pen device.
Figure 2:
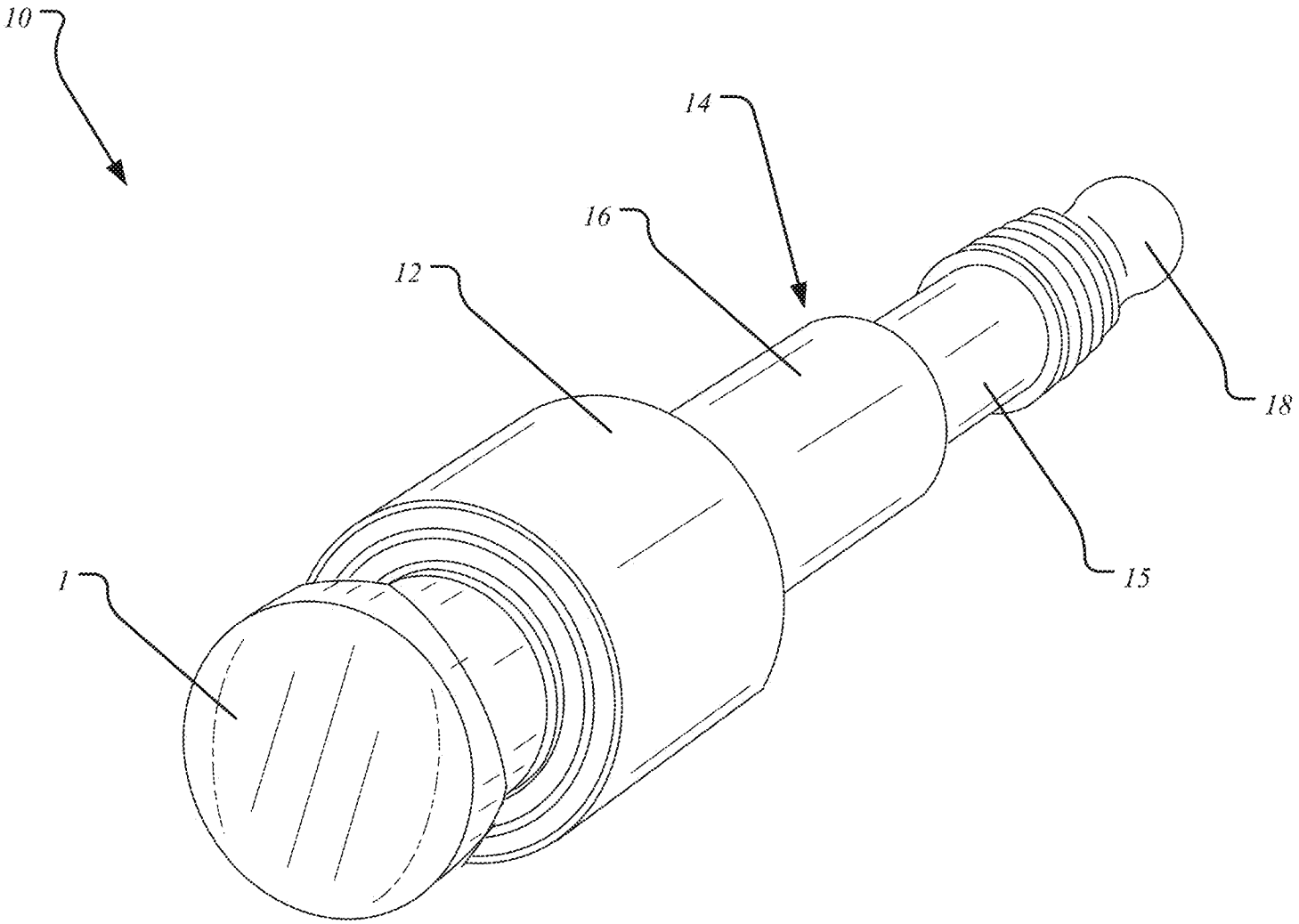

FIG. 1 is a perspective illustration of an example smoking pen device 10 with an electric heating coil shown separately. FIG. 2 is a perspective illustration of the example smoking pen device 10 with the electric heating coil 1 shown inserted into a first end piece 12 (also referred to herein as a 'Vaporizer' or "stem body") of the smoking pen device 10. In an example, the electric heating coil 1 is a so-called "cigarette lighter" for use with a 12*v* DC power outlet found in most automobiles, boats, ATVs, and other places. An AC electric connection can also be provided (e.g., via an AC/DC transformer).

The example smoking pen device 10 includes a stem. In an example, the stem is configured to provide girth and style. For example, the stem may provide a finger grip and/or be a decorative cover. The stem may be manufactured of stainless steel or other suitable material. The stem may also include a logo/name, other information, and/or decoration.

Figure 4:
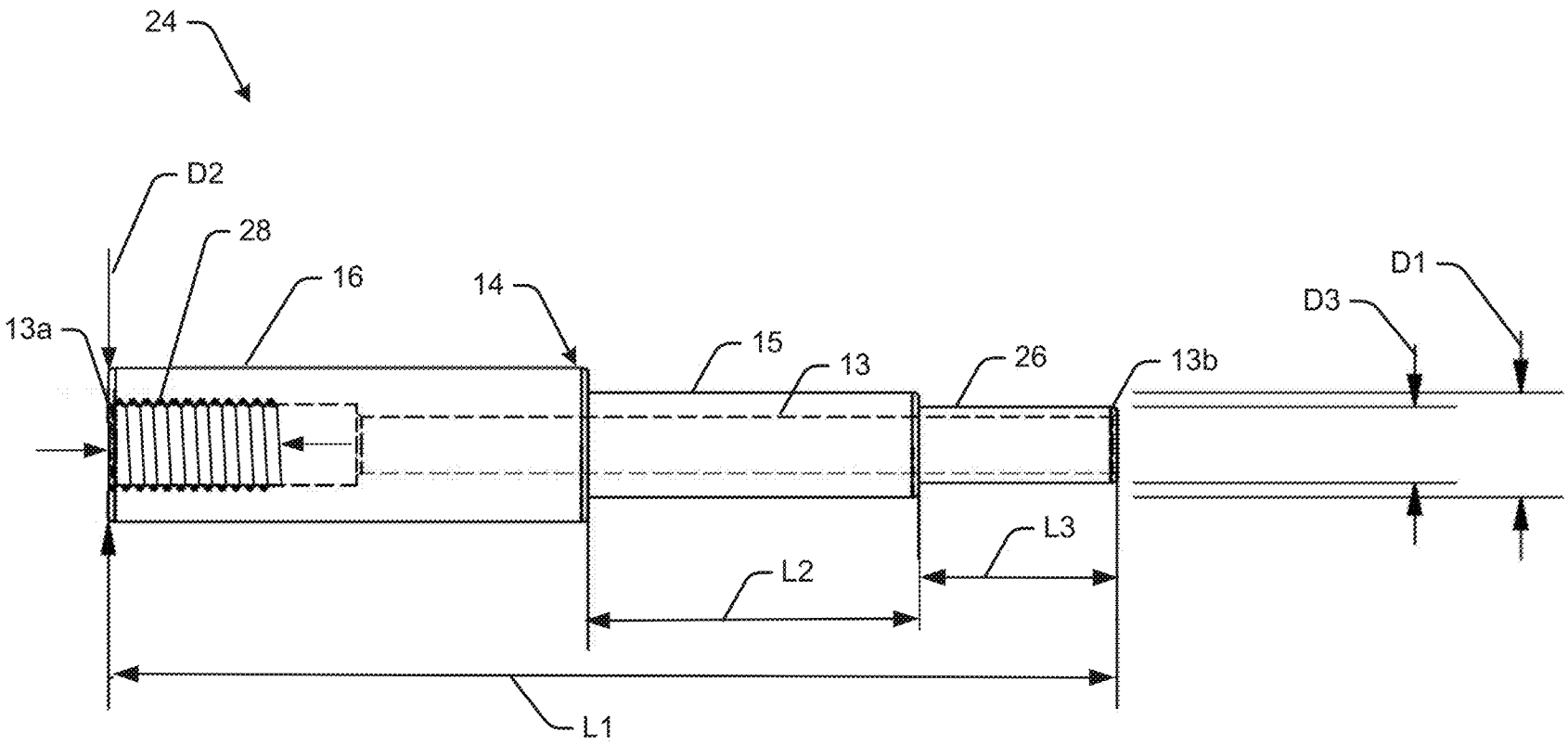
FIG. 4 is a side cross-sectional view of the example stem shown in FIG. 3.

In an example, the stem may form the conduit 13 having an inlet end 13*a* and an outlet end 13*b* (see, e.g., FIG. 4). In another example, the stem may include a separate tube and outer sleeve 14.

In an example, the outer sleeve 14 may include a first cylinder portion 15, and a second cylinder portion 16. As shown, the first cylinder 15 is mated to the second cylinder 16, and the first cylinder 15 has an outer diameter which is smaller than the outer diameter of the second cylinder 16. The outer diameter of the second cylinder 16 is also smaller than an outer diameter of the first end piece 12. This enables a step-down configuration from the first end piece 12 to the second end piece 18. It is noted, however, that other configurations are also possible. For example, the outer sleeve 14 may include a uniform outer diameter along the entire length of the outer sleeve 14, or the outer sleeve 14 may be tapered. Still other configurations are also contemplated, as will be readily appreciated by those having ordinary skill in the art after becoming familiar with the teachings herein.

The second end piece 18 is provided on the outlet end of the conduit 13. In an example, the second end piece 18 may be manufactured of a rubber or silicone material. Of course, other materials may also be used. The second end piece may have a ribbed portion.

In an example, the second end piece 18 is configured to fit into an inlet port on a water pipe. For example, the second end piece 18 may be implemented in place of a slide for a water pipe. In another example, the second end piece 18 is a mouth piece.

During use, a smoking product (e.g., plant or oil) can be provided by the end-user into a chamber formed within the first end piece 12. The electric heating coil 1 is heated and then pressed into the first end piece 12 to combust the smoking product. A breather hole 20 (see, e.g., FIG. 6) may be provided in first end piece 12 to provide oxygen and aid in combusting the smoking product. A screen 22 and/or filter may be provided in the chamber of the first end piece 12 to reduce or altogether prevent ash from the combusting smoking product and/or the smoking product itself from traveling into and/or clogging the conduit 13. In an example, the screen 22 is held in place with a snap ring or other retaining device.

Gas or vapor from combustion of the smoking product exits the first end piece 12 via the inlet end 13*a* of the conduit 13, travels through the conduit 13, and exits at the outlet end 13*b* of the conduit 13, e.g., via the second end piece 18.

In an example, the second end piece 18 may be a mouth piece, so that the gas or vapor can be inhaled directly. In another example, the second end piece 18 may be configured for insertion into an inlet port on a water pipe or other device.

Following use, the electric heating coil 1 may be removed, and the combusted (and uncombusted, if any) smoking product can be emptied from the chamber of the first end piece 12. The chamber and screen 22 may also be cleaned as desired. The electric heating coil may be stored separately or within the first end piece 12.

Before continuing, it should be noted that the examples described above are provided for purposes of illustration, and are not intended to be limiting. Other devices and/or device configurations may be utilized. For example, the components shown in the drawings are shown only for purposes of non-limiting example. The smoking pen is not limited to any particular type of component, material, size and/or dimension. By way of illustration, the smoking pen device can be made of any suitable material (metal such as titanium, ceramics, glass, quartz, etc.). Other variations will be readily apparent to those having ordinary skill in the art after becoming familiar with the teachings herein.

Figure 3:
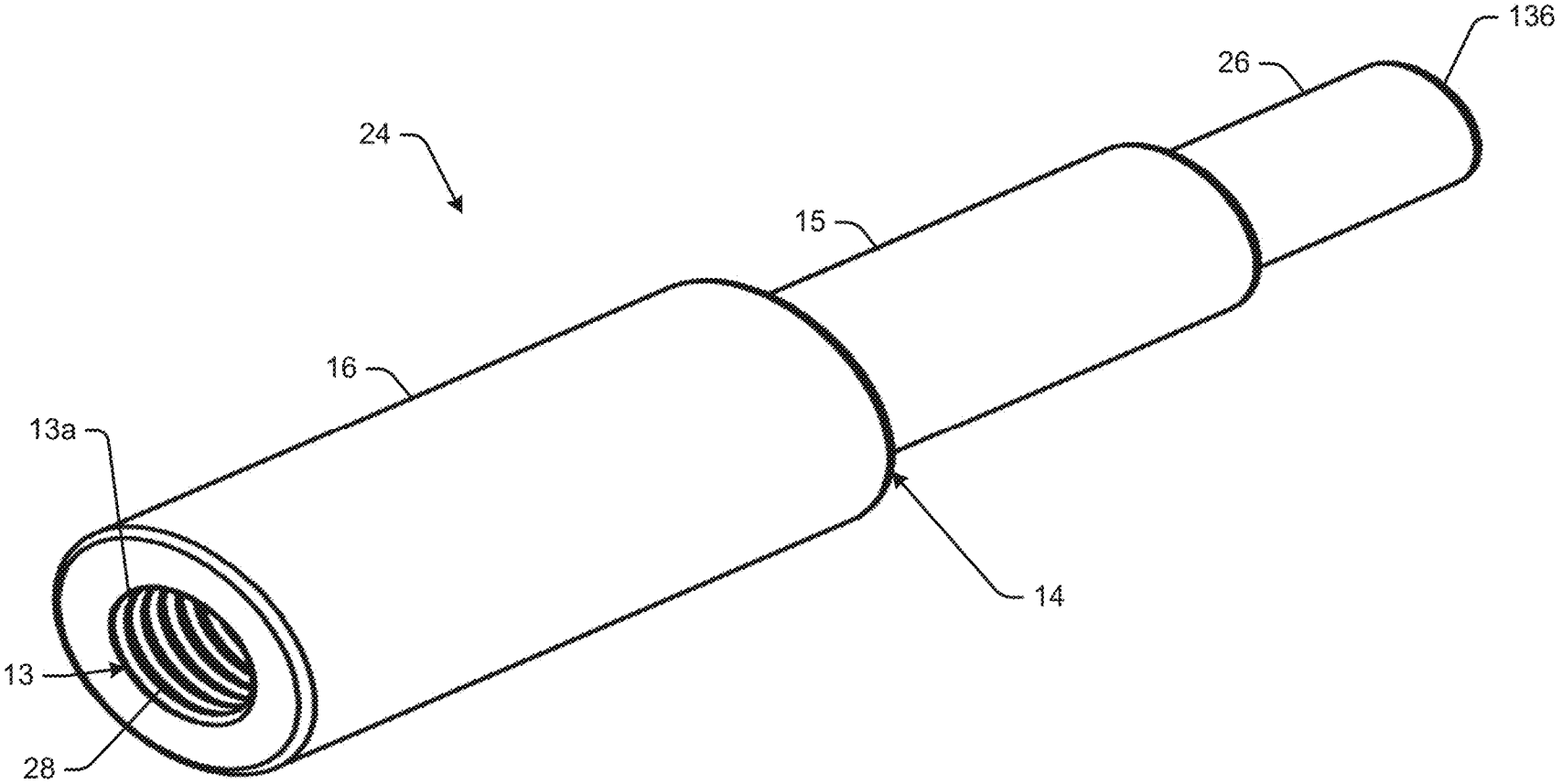
FIG. 3 is a perspective view of an example stem of the example smoking pen device.
Figure 5:
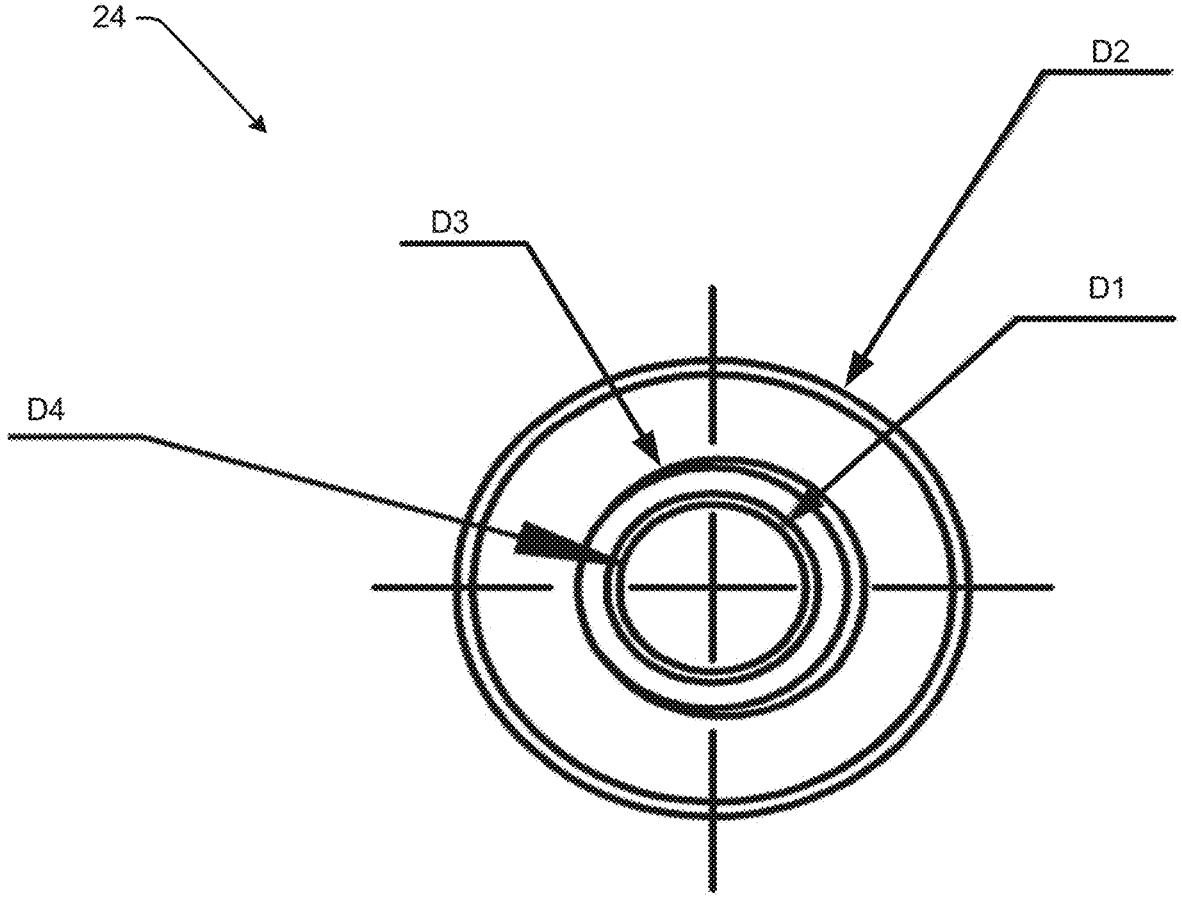
FIG. 5 is a front plan view of the example stem shown in FIG. 3.

FIG. 3 is a perspective view of an example stem 24 of the example smoking pen device 10. FIG. 4 is a side cross-sectional view of the example stem 24 shown in FIG. 3. FIG. 5 is a front plan view of the example stem 24 shown in FIG. 3.

In an example, the stem 24 provides an outer sleeve 14. The stem 24 may be formed as a number of cylinders (e.g., 15, 16, and 26) with an internal conduit 13. In an example, the first end piece 12 may be mated with (e.g., threaded onto) the first cylinder 15. The second end piece 18 may be mated with (e.g., fitted over) a third cylinder 26 of the stem 24. The stem 24 may provide a decorative cover and/or a finger grip.

In an example, the first cylinder 15 is mated to the second cylinder 16. The first cylinder 15 has an outer diameter D1 (e.g., about 0.43 inches) which is smaller than the outer diameter D2 (e.g., about 0.63 inches) of the second cylinder 16. The first cylinder 15 is also mated to the third cylinder 26. The third cylinder 16 has an outer diameter D3 (e.g., about 0.30 inches) which is smaller than the outer diameter D1 of the first cylinder 15. The outer diameter D2 of the second cylinder 16 is smaller than an outer diameter (not shown in FIG. 4) of the first end piece 12. An internal diameter D4 of the conduit 13 is the same as an internal diameter (not shown in FIG. 4) of the first end piece 12.

In an example, the overall length L1 of the stem 24 is about 3.05 inches. The first cylinder 15 has a length L2 of about 1.0 inch. The third cylinder 26 has a length L3 of about 0.60 inches.

In an example, the first end piece 12 may be mated to the second cylinder 16 of the stem by threading. The internal/female threaded portion 28 of the second cylinder 16 extends for a length L1.

It is noted that relative sizes and dimensions provided herein are for purposes of illustration only.

Figure 6:
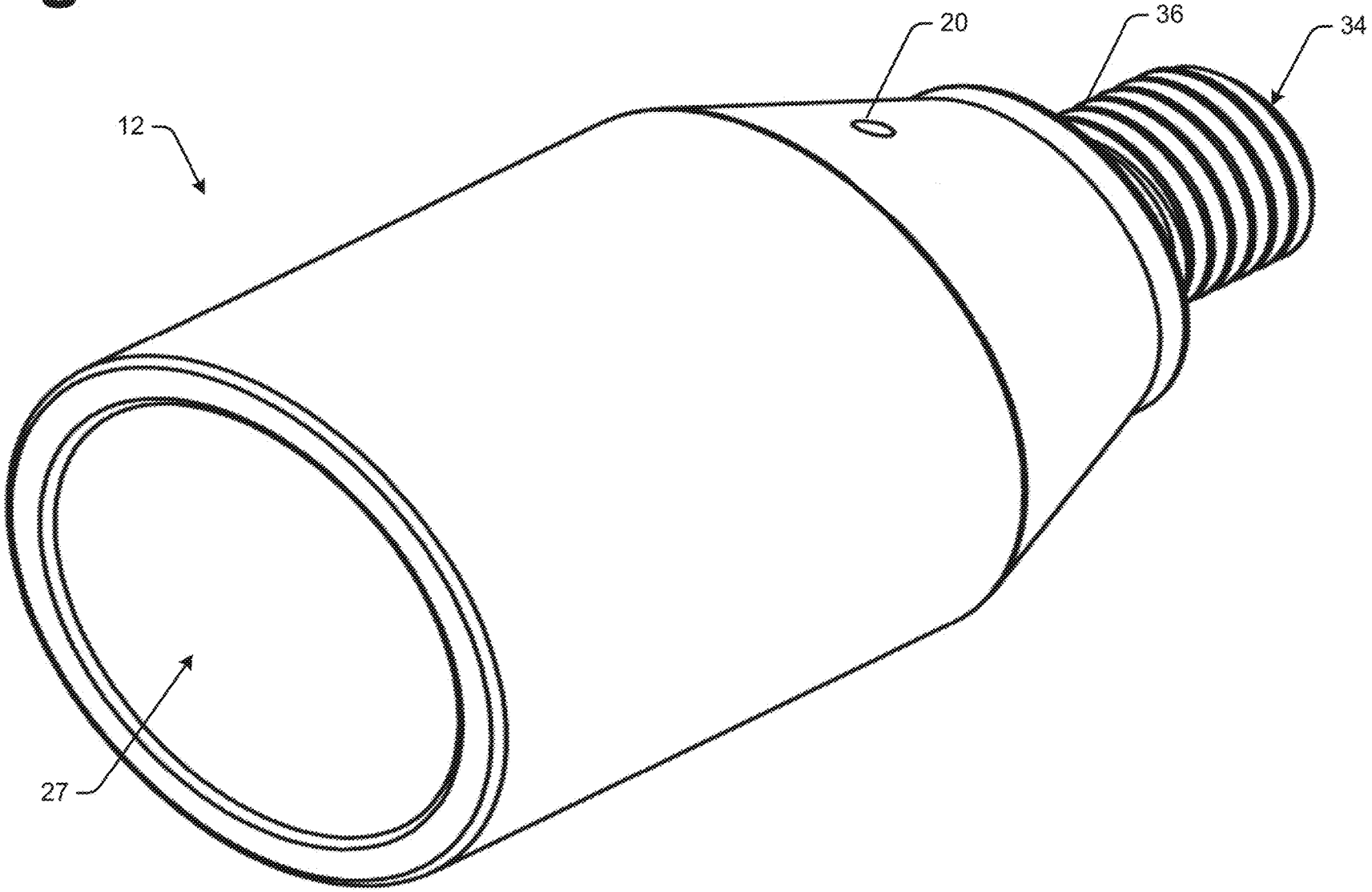
FIG. 6 is a perspective view of an example end piece of the example smoking pen device.
Figure 7:
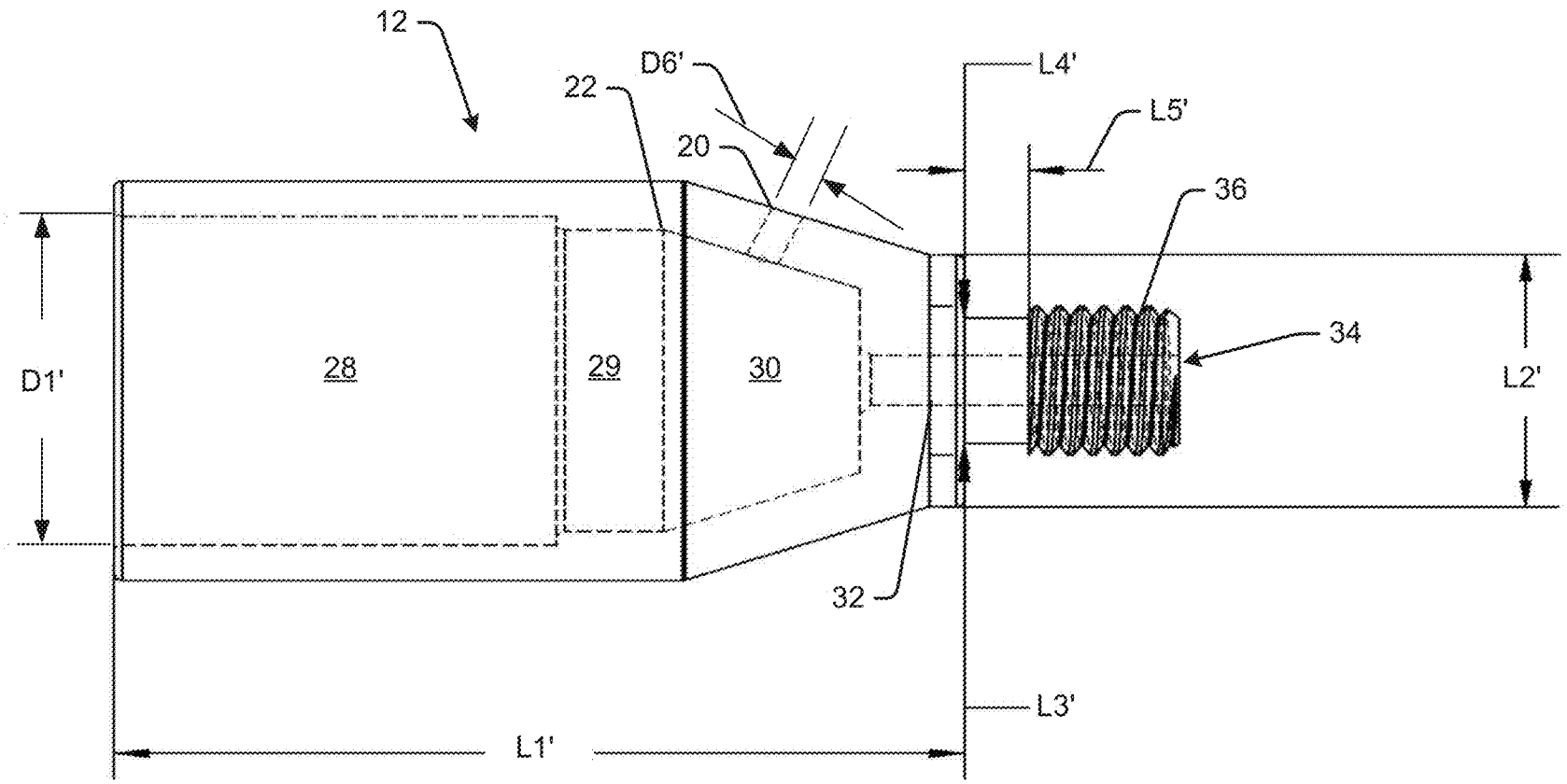
FIG. 7 is a side cross-sectional view of the example end piece shown in FIG. 6.
Figure 8:
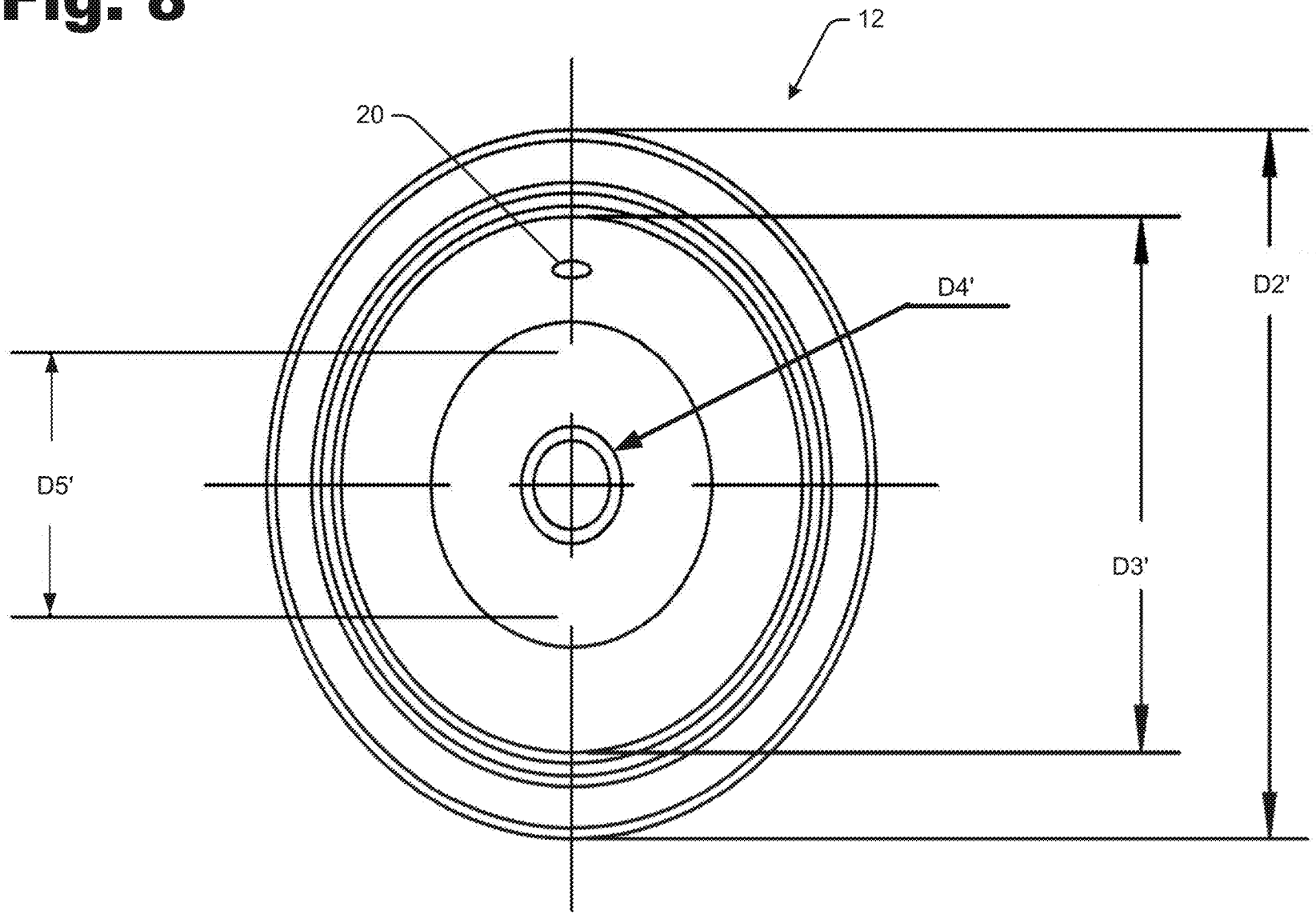
FIG. 8 is a front plan view of the example end piece shown in FIG. 6.

FIG. 6 is a perspective view of an example end piece (vaporizer or stem body) 12 of the example smoking pen device 10. FIG. 7 is a side cross-sectional view of the example stem body 12 shown in FIG. 6. FIG. 8 is a front plan view of the example stem body 12 shown in FIG. 6.

In an example, the stem body 12 includes a chamber 27 configured to receive the smoking product, and also to receive the electric heating coil 1. The electric heating coil 1 may be inserted and removed in portion 28 of the chamber 27. In an example, the smoking product may be deposited into portion 29 of the chamber 27, in front of the screen 22.

The mesh or screen 22 may be fitted into the chamber 27 and held in place by a snap ring or other suitable retainer. The screen 22 aids in holding the concentrate or other smoking material in place for vaporizing. In an example, the screen 22 is made of titanium grade 2 or stainless steel, although other materials may also be used.

Gas and/or vapor is formed portion 30 of the chamber 27. Opening or "breather" 20 is provided in portion 30 of the chamber 27 to assist combustion and prevent occurrence of an internal vacuum. The gas and/or vapor exits the stem body 12 via conduit 32 and outlet 34. The stem body 12 is connected (e.g., by male threading 36 to female threading 28) to the stem 24, so that the outlet 34 provides a passage for the gas and/or vapor into conduit 13 in the stem 24.

In an example, the stem body 12 may be made of stainless steel, grade 2 titanium, quartz, glass, ceramic, or other suitable material. The stem body 12 is threaded on top to attach to stem 24. However, the stem body 12 and stem 24 may be attached in any suitable manner and/or integrally formed as a single part. It is noted, however, that removing the stem body 12 from the stem 24 enables easy disassembly for cleaning.

In an example, portion 28 of the chamber 27 has an inner diameter D1' of about 0.82 inches and an outer diameter D2' (or overall height) of about 1.0 inches. Portion 29 of the chamber 27 has an inner diameter D3' of about 0.76 inches. Portion 30 tapers from an inner diameter D3' of about 0.76 inches on a first end, to an inner diameter D5' of about 0.37 inches on a second end. The conduit 32 has an inner diameter D4' about the same as the inner diameter D4 of the stem conduit 13.

In an example, the opening 20 has an inner diameter D6' of about 0.06 inches. Other dimensions include L1 of about 1.59 inches, L2' of 0.63 inches, L3' of 0.37 inches, L4' of about 0.32 inches, and L5' of about 0.12 inches.

It is noted that the examples shown and described are provided for purposes of illustration and are not intended to be limiting. Still other examples are also contemplated.

The invention claimed is:

1. A smoking pen device comprising:

a stem having an inlet end and an outlet end, the stem having a first cylinder mated to a second cylinder, and the first cylinder mated to a third cylinder;

a conduit formed through the cylinders of the stem, the first cylinder having an outer diameter D1 smaller than an outer diameter D2 of the second cylinder, and the third cylinder having an outer diameter D3 smaller than the outer diameter D1 of the first cylinder;

wherein an overall length L1 of the stem is about 3 inches, with the first cylinder having a length L2 of about 1 inch, and the third cylinder having a length L3 of less than 1 inch;

an end piece connecting to the inlet end of the stem adjacent the second cylinder, the outer diameter D2 of the second cylinder smaller than an outer diameter of the adjacent end piece, the internal diameter D4 of the conduit is the same as an internal diameter of the end piece;

an electric coil;

a chamber of the end piece, wherein the electric coil is inserted into the chamber of the end piece to combust a smoking product in the chamber of the end piece, wherein a gas or vapor from combustion of the smoking product flows from the end piece through the conduit of the stem toward the outlet end of the stem.

2. The smoking pen device of claim 1, further comprising a second end piece on the outlet end of the stem.

3. The smoking pen device of claim 2, further comprising the second end piece fitting into an inlet port on a water pipe.

4. The smoking pen device of claim 2, wherein the second end piece is a mouth piece.

5. The smoking pen device of claim 4, wherein the mouth piece has a ribbed portion.

6. The smoking pen device of claim 1, wherein the stem provides a decorative cover.

7. The smoking pen device of claim 1, wherein the stem further comprises a finger grip.

8. The smoking pen device of claim 1, wherein the end piece is threaded onto the stem.

9. The smoking pen device of claim 1, wherein the end piece further comprises a breather opening formed therein.

10. The smoking pen device of claim 1, further comprising a screen held in place by a snap ring in the end piece.

11. A smoking pen device comprising:

a stem having an inlet end and an outlet end, the stem having a first cylinder mated to a second cylinder, and the first cylinder mated to a third cylinder;

a conduit formed through the cylinders of the stem, the first cylinder having an outer diameter D1 smaller than an outer diameter D2 of the second cylinder, and the third cylinder having an outer diameter D3 smaller than the outer diameter D1 of the first cylinder;

a first end piece connecting to the inlet end of the stem;

a separate and removable coil heated by electric current, the coil received in the first end piece after being heated to combust a smoking product in a chamber of the first end piece, the coil removed from the first end piece to remove combusted smoking product;

a second end piece on the outlet end of the stem;

a breather opening formed in the first end piece therein; and a screen and a snap ring, the screen held in place in the first end piece by the snap ring.

12. The smoking pen device of claim 11, wherein the second end piece is a mouth piece.

13. The smoking pen device of claim 11, wherein the second end piece fits into an inlet port on a water pipe.

* * * * *